US008042750B2

(12) United States Patent
Erhard et al.

(10) Patent No.: US 8,042,750 B2
(45) Date of Patent: Oct. 25, 2011

(54) RELEASE AGENT SPRAY DEVICE FOR A CASTING MACHINE

(75) Inventors: Norbert Erhard, Lorch (DE); Hubert Pschenitschni, Winterbach (DE)

(73) Assignee: Oskar Frech GmbH & Co. KG, Schorndorf (DE)

( * ) Notice: Subject to any disclaimer, the term of this patent is extended or adjusted under 35 U.S.C. 154(b) by 210 days.

(21) Appl. No.: 12/325,805

(22) Filed: Dec. 1, 2008

(65) Prior Publication Data

US 2009/0302192 A1 Dec. 10, 2009

(30) Foreign Application Priority Data

Nov. 30, 2007 (EP) ..... 07023220

(51) Int. Cl.
*B05B 7/12* (2006.01)

(52) U.S. Cl. ..... 239/412; 239/433; 184/7.4; 184/55.1

(58) Field of Classification Search ..... 239/412, 239/433; 184/7.4, 55.1
See application file for complete search history.

(56) References Cited

U.S. PATENT DOCUMENTS 3,693,757 A * 9/1972 Callahan et al. ..... 184/7.4
3,888,420 A 6/1975 Boelkins
4,714,199 A * 12/1987 Heath et al. ..... 239/412
4,955,953 A * 9/1990 Kayser ..... 184/42
2004/0217212 A1 11/2004 Erhard et al.

FOREIGN PATENT DOCUMENTS

DE 32 38 201 A1 6/1984
EP 0 627 268 A2 12/1994
EP 1 468 745 A1 10/2004

OTHER PUBLICATIONS

European Search Report dated May 26, 2008 with English translation of relevant portion (nine (9) pages).

* cited by examiner

*Primary Examiner* — Dinh Nguyen
(74) *Attorney, Agent, or Firm* — Crowell & Moring LLP

(57) ABSTRACT

1. Release agent spray device for a casting machine.

2.1. The invention relates to a release agent spray device for a casting machine, having one or more spray nozzles (1) and discharge means for the controlled discharge of release agent from the respective spray nozzle.

2.2. According to the invention, the discharge means comprise at least one dosing unit (3) which is assigned to at least one spray nozzle (1) and which defines, in advance, a release agent quantity to be discharged by the at least one associated spray nozzle in an impending spray burst and which provides said release agent quantity, separated from a release agent supply, for discharge in the impending spray burst.

2.3. Use for example for metal pressure-die-casting machines.

10 Claims, 3 Drawing Sheets

RELEASE AGENT SPRAY DEVICE FOR A CASTING MACHINE

CROSS REFERENCE TO RELATED APPLICATIONS

This application claims the priority of European patent application no. 07023220.2, the contents of which are incorporated herein in its entirety by reference.

BACKGROUND OF THE INVENTION

1. Field of the Invention

The invention relates to a release agent spray device for a casting machine, as per the preamble of Claim 1.

2. Description of the Related Art

Release agent spray devices of said type are used for example as release agent spray systems for the automatic spraying of casting moulds in pressure-die-casting machines. With increasing demands on casting quality, service life, servicing, material consumption and environmental protection, the demands on release agent spray systems increase correspondingly.

It is known for the release agent to be discharged via one or more spray nozzles in intermittent spray bursts by virtue of a blockable release agent supply line which leads to the respective spray nozzle being opened only for a certain period of time during the spray burst, and compressed air simultaneously being supplied to the spray nozzle, such that release agent is sucked into the spray nozzle and is discharged from the latter, with compressed air assistance, as a spray jet. The laid-open specification DE 32 38 201 A1 and patent publication EP 1 468 745 B1 describe release agent spray devices of said type in which a control piston which can be actuated by means of control air is provided for opening and blocking the release agent supply line to the spray nozzle. In this way, the quantity of release agent discharged per spray burst is dependent inter alia on the adjustable stroke of the control piston and on the opening time of the latter, during which said control piston opens the release agent supply line. On account of the additional dependency on further parameters, such as release agent pressure, geometry and in particular cross section of the spray nozzle, and pressure and time duration of the spray air burst which is supplied to the spray nozzle and which sucks in the release agent, the release agent quantity which is sprayed per spray burst and spray nozzle is not precisely known and is also not precisely predefined in said conventional spray systems.

To obtain short cycle times in the casting process, for modern pressure-die-casting machines, there is a demand for correspondingly fast release agent spray systems, and accordingly very short spray times with a consistently good, reproducible spray characteristic. In particular, the spray characteristic and in particular the sprayed release agent quantity should also not be influenced by any switching delays of system components which are involved, such as check valves and the like. Furthermore, the sprayed release agent quantity should be kept to a minimum.

It is an object of the invention to provide a release agent spray device of the type specified in the introduction which permits a reliable discharge of a predefinable release agent quantity in a respective spray burst via one or more spray nozzles.

SUMMARY OF THE INVENTION

The invention achieves this object by providing a release agent spray device comprising one or more spay nozzles and discharge means for the controlled discharge of release agent from the respective spray nozzle, wherein the discharge means comprise at least one dosing unit which is assigned to at least one spray nozzle and which defines, in advance, a release agent quantity to be discharged by the at least one associated spray nozzle in an impending spray burst and which provides said release agent quantity, separated from a release agent supply, for discharge in the impending spray burst.

With said release agent spray device according to the invention, it is possible for even comparatively small release agent quantities to be precisely dosed and discharged per spray burst, even in the case of short spray times and/or a low release agent pressure and/or a relatively small nozzle cross section. The fixed release agent quantity defined by the dosing unit for the impending spray burst is provided separately from a release agent supply such as a supply of release agent from a release agent source via a release agent supply line, and may be discharged in the impending spray burst without being influenced by varying system parameters, and/or system parameters which are not precisely known, such as release agent pressure, nozzle geometry and pressure profile and the time duration of the spray air burst supplied to the spray nozzle in each case. The precise discharge of the desired release agent quantity per spray burst is not influenced, even in the case of very short spray times, by any switching delays or other functional characteristics, which are not precisely known or reproducible, of the system components which are involved, such as valves, control pistons and the like.

In a refinement of the invention, the respective dosing unit comprises a release agent chamber which is connected, in a blockable manner, to a release agent source via a release agent supply line and to the at least one associated spray nozzle via a nozzle connecting line, and said respective dosing unit also comprises a dosing element which is movable and thereby delimits the release agent chamber with a variable volume. In this way, the release agent quantity which is to be discharged in the impending spray burst via the one or more associated spray nozzles may be stored in the release agent chamber, from where it can then be discharged in the impending spray burst.

In a further refinement of said measure, a non-return valve is provided in the release agent supply line and/or in the nozzle connecting line, or a multi-way valve is provided for selectively blocking the connection of the release agent chamber to the spray nozzle and opening the connection of the release agent chamber to the release agent source, or opening the connection of the release agent chamber to the spray nozzle and blocking the connection of the release agent chamber to the release agent source. Said automatic valve control means permit the desired supply of release agent into the release agent chamber before the next spray burst, and the discharge of the release agent quantity stored there via the one or more associated spray nozzles in the next spray burst, without release agent passing back from the release agent chamber into the release agent supply line or the release agent source. In a further refinement, the dosing element is situated in a common housing body together with one of the one or more associated spray nozzles, such that the dosing element can be installed as a modular unit with the related spray nozzle.

In a further refinement, the dosing element has a control medium chamber which is connected to a control medium source and by means of which the dosing element can be controlled. In a further refinement the control medium source can have means for the controlled loading of the dosing element with at least two different control pressures, with a first control pressure activating the dosing element for the dosing of release agent into the release agent chamber, and with a second control pressure, which differs from the first, activating the dosing element for the discharge of the dosed release agent out of the release agent chamber.

In a further refinement according to the invention, the discharge means are set up so as to variably set the release agent quantity to be discharged in each case in the next spray burst and/or by different dosing units. It is thus possible, if required, for different release agent quantities to be sprayed in successive spray bursts via the same spray nozzle, or for different release agent quantities to be sprayed in parallel via spray nozzles which are assigned to different dosing units.

In a further refinement of said measure, the dosing element is assigned an adjustable movement limiter for variably adjusting the release agent quantity which is dosed into the release agent chamber or discharged out of said release agent chamber. This is an advantageously simple measure for variably adjusting the release agent quantity to be ejected per spray burst.

BRIEF DESCRIPTION OF THE DRAWINGS

Advantageous embodiments of the invention are illustrated in the drawings and are described below. In the drawings.

DETAILED DESCRIPTION OF PREFERRED EMBODIMENTS

Figure 1:
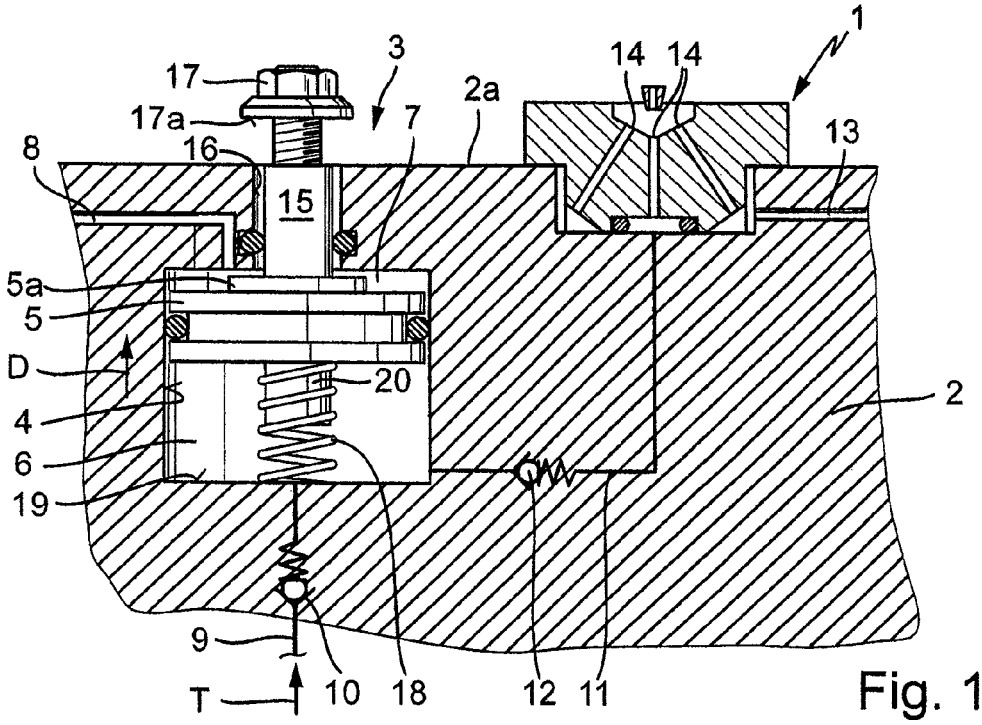
FIG. 1 shows a schematic cross-sectional detail view of a spray block of a release agent spray device, having a dosing piston as a dosing element and having a non-return valve, for a pressure-die-casting machine in a dosing situation.
Figure 2:
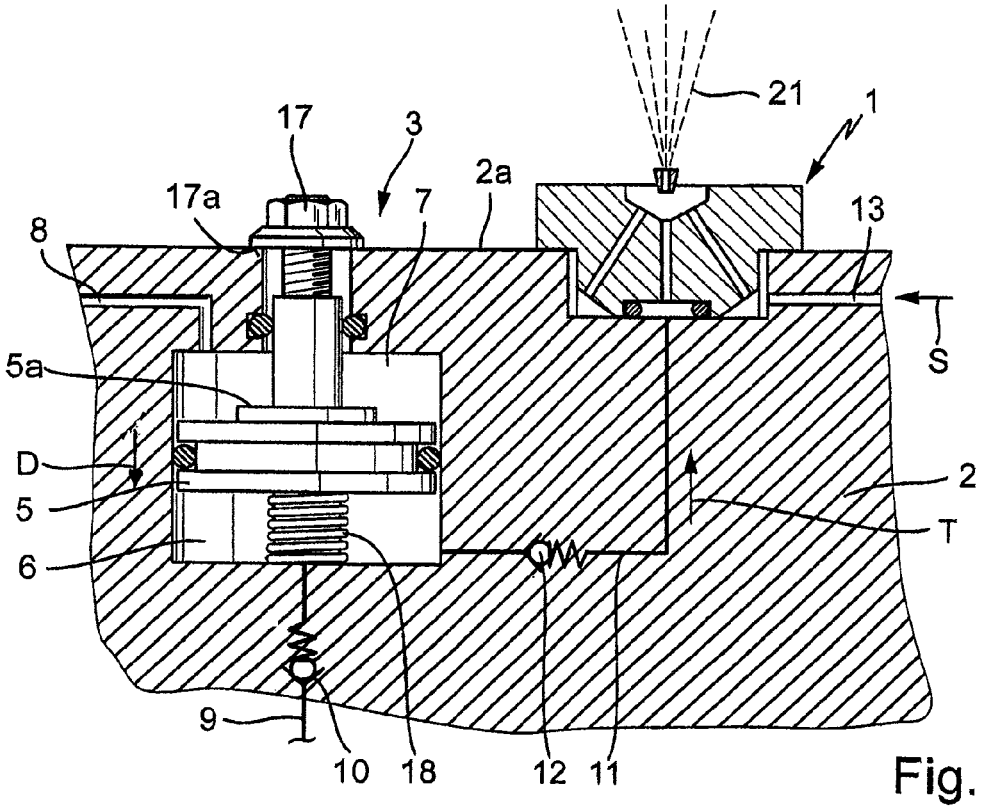
FIG. 2 shows a cross-sectional view corresponding to FIG. 1 in a discharge situation of the spray device.

The release agent spray device shown in FIGS. 1 and 2 with its components which are of interest in the present case is suitable for example for automatically spraying mould surfaces in pressure-die-casting machines, for example for metal pressure-die-casting, with a conventional release agent. Depending on requirements, the release agent spray device comprises one or more spray nozzles, of which a spray nozzle 1 is shown by way of representation in the views of FIGS. 1 and 2. The respective spray nozzle 1 is mounted on a spray side 2*a* of a spray block or housing body 2 in which are also provided one or more dosing units, of which a dosing unit 3, which is assigned to the spray nozzle 1 which is shown, is shown by way of representation in the view of FIGS. 1 and 2.

The dosing unit 3 which is shown comprises a hollow chamber 4 which is provided in the housing body 2 and which is divided, by a dosing piston 5 which functions as a dosing element and which is arranged so as to be axially movable, into a release agent chamber 6 and a control medium chamber 7. The control medium chamber 7 is connected by means of a control medium line 8 to a conventional control medium source (not shown). By means of a supply or discharge of compressed air or of some other gaseous or liquid control medium, it is possible for the control medium chamber 7 to be selectively pressurized or depressurized. The release agent chamber 6 is connected by means of a release agent supply line 9 to a conventional release agent source (not shown). A non-return valve 10 is arranged in the release agent supply line 9 in such a way that release agent can be fed from the release agent source into the release agent chamber 6 but a return flow of release agent from the release agent chamber 6 to the release agent source is blocked.

The spray nozzle 1 is connected to the release agent chamber 6 by means of a nozzle connecting line 11, with a non-return valve 12 being arranged in the nozzle connecting line 11 in such a way that release agent can be fed from the release agent chamber 6 to the spray nozzle 1 but a return flow into the release agent chamber 6 is blocked. The spray nozzle 1 is connected by means of a spray carrier medium line 13 to a conventional spray carrier medium source (not shown) in order to be able to supply a spray carrier medium, such as for example compressed air, to the spray nozzle 1, which spray carrier medium serves to effect the spraying of the liquid release agent which is supplied in parallel. A suitable geometric configuration of the spray nozzle 1 with associated nozzle ducts 1*a* results, in the conventional way, in a mixture of the spray carrier medium, for example air, with the release agent and the desired spray effect.

A piston shank 15 which extends from the dosing piston 5 is guided in a sealed fashion in a bore 16 which is formed into the housing body 2 from the spray side 2*a*. A set screw 17 is screwed into the piston shank 15 at the end side from the outside, which set screw 17 functions, with a stop 17*a*, as a variably adjustable stroke limiter. On the opposite side, the dosing piston 5 is supported on a coil spring 18 which in turn is supported on a base surface 19 of the release agent chamber 6 and is secured against lateral displacement by a piston shank stub 20.

Depending on requirements and on the application, it is possible for in each case one dosing unit to be assigned individually to a spray nozzle, that is to say in this case, only one spray nozzle is connected to the release agent chamber of the associated dosing unit. Alternatively, it is possible for a plurality of spray nozzles to be coupled in parallel to one dosing unit. In other words, in corresponding embodiments of the invention, for a given number and arrangement of spray nozzles, only one dosing unit is provided for all the spray nozzles, or a number of dosing units corresponding to the number of spray nozzles are provided so as to be assigned to in each case one spray nozzle, or a plurality of dosing units are provided, at least one of which is assigned to a plurality of spray nozzles. Here, it is likewise possible depending on requirements and on the application for in each case one dosing unit and the associated spray nozzle(s) to be integrated as shown into a common spray block module body, in order to then construct an entire spray system in a modular fashion from a plurality of spray block modules, or alternatively all or in any case a plurality of dosing units with their coupled-on spray nozzles are integrated in one spray block. In the event of a plurality of spray nozzles being provided, the latter may be of identical or different construction, for example, it is possible for a plurality of dosing units with the same or different cross section of the release agent chamber to be provided, each of which is assigned an individually definable number of spray nozzles.

Depending on requirements, the discharge means used in the release agent device according to the invention comprise, in addition to the components mentioned above, such as in particular the dosing unit(s) and the associated medium lines or medium ducts, further system components which are of conventional type and which are therefore not shown or explained in any more detail here. In particular, the discharge means comprise a suitable spray control unit for activating the device components which are involved. It is self-evident that a suitable control algorithm is implemented in said control unit in order to carry out the release agent spraying process according to the invention, as is described in more detail below.

The release agent spray device explained above on the basis of FIGS. 1 and 2 permits, by means of its special discharge means for the controlled spray burst discharge from the respective spray nozzle 1 using the characteristic nozzle unit(s) 3, the discharge of a very precisely definable release agent quantity per spray burst by virtue of a corresponding release agent quantity being sucked by the dosing piston 5 into the release agent chamber 6 before a respective spray burst, which release agent quantity is subsequently, during the next spray burst, pushed by the dosing piston 5 to the coupled-on spray nozzle(s) 1 and discharged or sprayed out of the latter.

In this respect, FIG. 1 shows the operating state during the suction of release agent. The control medium chamber 7 is relieved of pressure by means of a discharge of control medium via the control medium line 8, such that the dosing piston 5 moves upward in FIG. 1, that is to say in a direction of an enlargement of the release agent chamber 6, on account of the pressure force of the coil spring 18 and/or of a vacuum in the control medium chamber 7. Consequently, release agent flows via the release agent supply line 9 and the opening non-return valve 10 from the release agent source into the release agent chamber 6, with the non-return valve 12 in the nozzle connecting line 11 remaining closed. The sucked-in release agent quantity can thereby be precisely defined by the suction stroke of the dosing piston 5. Said suction stroke may be defined in that a stop 5*a* which is provided on the dosing piston 5 comes into contact against an upper delimiting surface in FIG. 1 of the control medium chamber 7. Alternatively, it is possible for a limitation of the suction stroke of the dosing piston 5 to be provided by correspondingly setting a constant limiting pressure of the control medium in the control medium chamber 7, that is to say, in the corresponding end position of the dosing piston 5, the pressure force of the coil spring 18 has decreased to the value of a predefined remaining pressure force of the control medium on the dosing piston 5.

After the suction process is complete, the subsequent spray burst process can be initiated, as shown in FIG. 2. For this purpose, by means of a supply of pressure medium via the control medium line 8, the control medium pressure in the control medium chamber 7 is increased to a sufficient extent such that the dosing piston 5 is moved in the direction of a reduction in size of the release agent chamber 6, that is to say downwards in FIG. 2, counter to the force of the pressure spring 18. This has the result that the non-return valve 12 in the nozzle connecting line 11 opens, such that release agent is fed from the release agent chamber 6 via the nozzle connecting line 11 to the spray nozzle 1, while the non-return valve 10 in the release agent supply line 9 closes and a release agent return flow to the release agent source is prevented. The movement of the dosing piston 5 is denoted in FIGS. 1 and 2 by a movement arrow D, and the release agent flow is denoted by a respective flow arrow T.

Together with the release agent, the spray nozzle 1 is supplied with the spray carrier medium, as denoted by a flow arrow S, such that the spray nozzle 1 sprays the supplied release agent in a spray jet 21, with it being possible by means of a corresponding configuration of the spray nozzle 1 and supply of the release agent and of the spray carrier medium to set a desired characteristic for the spray jet 21, for example in terms of geometry and direction, and if required also variable. If required, the spray nozzle 1 may for this purpose be designed, in the conventional way, on the basis of internal or external mixing principles.

The end of the discharge movement of the dosing piston 5 in the respective spray burst is defined by an abutment of the piston stroke limiter 17*a* of the set screw 17 against the spray side 2*a* of the housing body 2. Said end position is shown in FIG. 2. Said end position of the dosing piston 5 can be variably adjusted by means of a corresponding adjustment of the set screw 17. It is self-evident that, as an alternative to the variably adjustable piston stroke limiter 17*a* of the set screw 17, it is possible to provide any desired other piston-stroke-limiting measure which is known per se to a person skilled in the art. For example, the maximum compressed state, or the state of compression up to a degree which can be determined by the discharge control pressure of the control medium, of the coil pressure spring 18 can define an alternative end stop of said type, or some other conventional end stop is provided which is invariant or variably adjustable internally or in a remote-controlled fashion from the outside.

The two opposite end positions of the dosing piston 5 which are defined in the manner explained above define the stroke of the dosing piston 5 and therefore also precisely define the release agent volume which is sucked into and stored in the release agent chamber 6 before the respective spray burst and which is subsequently discharged or sprayed, in precisely said previously sucked-in quantity, in the next spray burst via the spray nozzle(s). As a result of said design of the dosing unit 3, it is consequently also possible for each individual spray burst for even very small release agent quantities to be precisely defined, stored in the release agent chamber 6 and sprayed in the respective spray burst. Here, the release agent quantity to be discharged in the respective spray burst may, depending on the system design, be invariably or variably defined as explained. If required, it is also possible for the release agent quantity to be variably predefined for successive spray bursts of the same spray nozzle, and/or for different release agent quantities to be defined for different spray nozzles. The discharge of the defined, predetermined release agent quantity in the respective spray burst is separated, that is to say decoupled, from the release agent supply from the release agent source.

Figure 3:
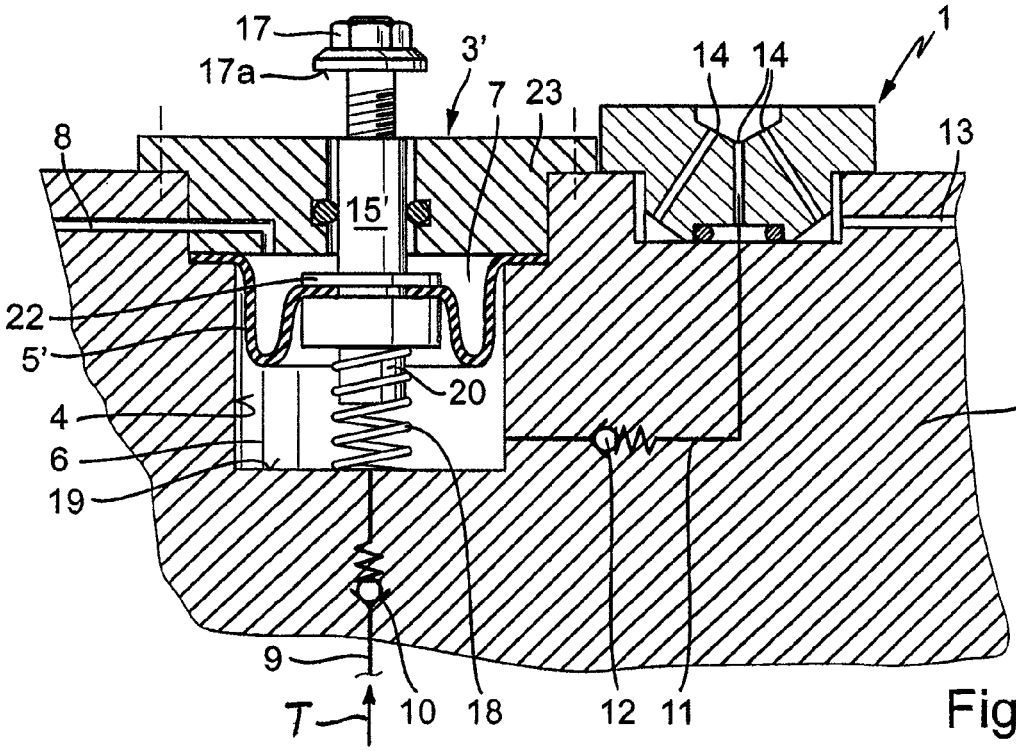
FIG. 3 shows a cross-sectional view corresponding to FIG. 1 for a variant with a dosing diaphragm as a dosing element.
Figure 4:
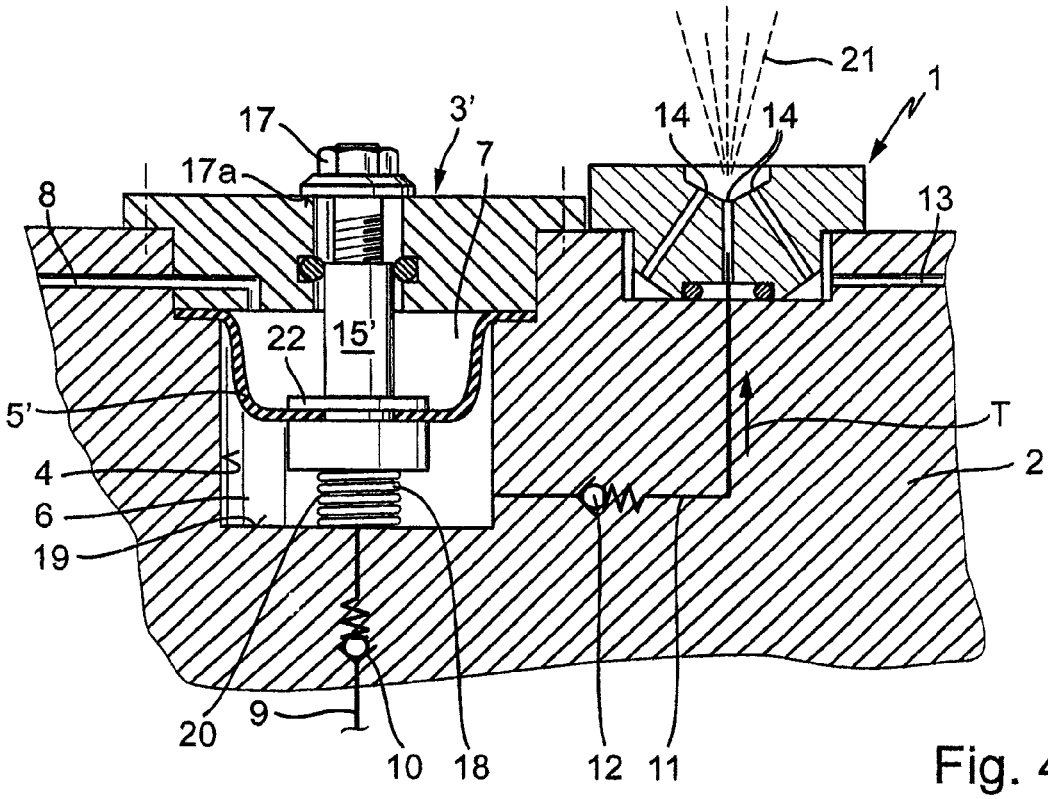
FIG. 4 shows a cross-sectional view corresponding to FIG. 2 for the variant with a dosing diaphragm.

FIGS. 3 and 4 show a variant of the release agent spray device shown in FIGS. 1 and 2, with identical or functionally equivalent components being provided with the same reference symbols, and with it being possible in this respect to make reference to the above explanations regarding the release agent spray device according to FIGS. 1 and 2. The release agent spray device according to FIGS. 3 and 4 differs from that of FIGS. 1 and 2 by a modified dosing unit 3'. In said dosing unit 3', an annular dosing diaphragm 5' assumes the function of the dosing piston 5 in the release agent spray device of FIGS. 1 and 2. The dosing diaphragm 5' is fixed in a fluid-tight fashion with its outer edge to the housing body 2, while being fixed in its central region to an axially movable diaphragm control pin 15'. For this purpose, the diaphragm 5' has a central opening through which the diaphragm control pin 15' extends. Situated on the diaphragm control pin 15' is a diaphragm retaining part 22 with an annular clamping gap in which the diaphragm 5' is held in a fluid-tight fashion with its central opening edge. The diaphragm control pin 15' otherwise has the corresponding components, as shown, and functions as the piston shank 15 in the exemplary embodiments of FIGS. 1 and 2, such that in this respect, reference can again be made to the corresponding above explanations with regard to FIGS. 1 and 2.

In the example of FIGS. 3 and 4, the hollow chamber 4 is formed by an inner part, of relatively small diameter, of a two-stepped bore in the housing body 2, with the inner part merging, so as to form an annular shoulder, into an outer part of greater diameter. The diaphragm 5' is placed with its outer edge onto the annular shoulder and is fixedly clamped there in a fluid-tight fashion by means of a closure piece 23 which is inserted in a fluid-tight fashion into the outer bore part. The closure piece 23 simultaneously forms the guide for the diaphragm control pin in that the latter extends through a central bore of the closure piece 23, with an annular seal being provided for sealing the annular gap between the diaphragm control pin 15' and the closure piece 23.

The dosing diaphragm 5' which is held in such a braced fashion functions, in a corresponding manner to the dosing piston 5 in the exemplary embodiment of FIGS. 1 and 2, as a separation element for dividing the hollow chamber 4 into the release agent chamber 6 and the control medium chamber 7. The axial movement of the diaphragm retaining bolt 15' moves the dosing diaphragm 5' between the folded diaphragm position shown in FIG. 3, with the relatively large volume of the release agent chamber 6, and the bulged diaphragm position shown in FIG. 4, with the relatively small volume of the release agent chamber 6. The movement of the diaphragm 5' and diaphragm control pin 15' between said two end positions takes place as in the exemplary embodiment of FIGS. 1 and 2, by means of a supply or discharge of compressed air or of some other control medium into or out of the control medium chamber 7 via the control medium line 8. FIG. 3 therefore corresponds, analogously to FIG. 1, to the operating state during the suction of release agent, while FIG. 4, analogously to FIG. 2, represents the spray burst process. Since, in this respect, the functionality corresponds entirely to that of the example of FIGS. 1 and 2, it is possible to make reference to the explanations given above in this regard. This also applies to the configuration and function of the means for defining the two end positions, shown in FIGS. 3 and 4, of the diaphragm control pin 15' and of the dosing diaphragm 5', and to those of the variable adjustment of the release agent quantity, which is to be discharged in the respective spray burst, by adjusting the set screw 17, which functions here with its stop 17*a* as a variably adjustable stroke limiter for the diaphragm control pin 15'.

Figure 5:
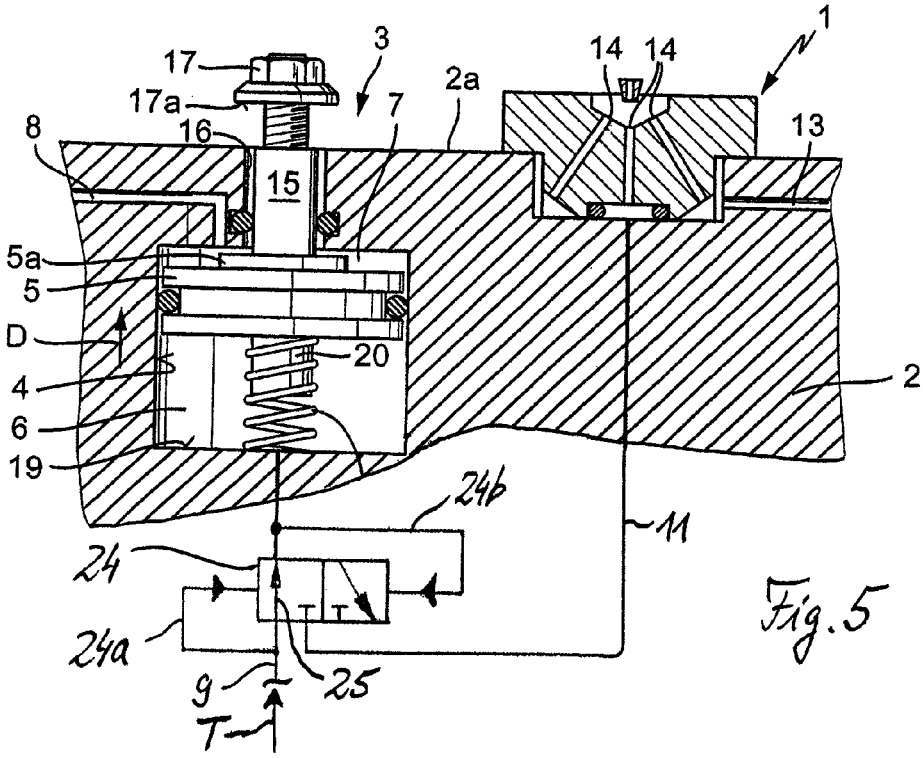
FIG. 5 shows a cross-sectional view corresponding to FIG. 1 for a variant with a directional control valve instead of the non-return valve.
Figure 6:
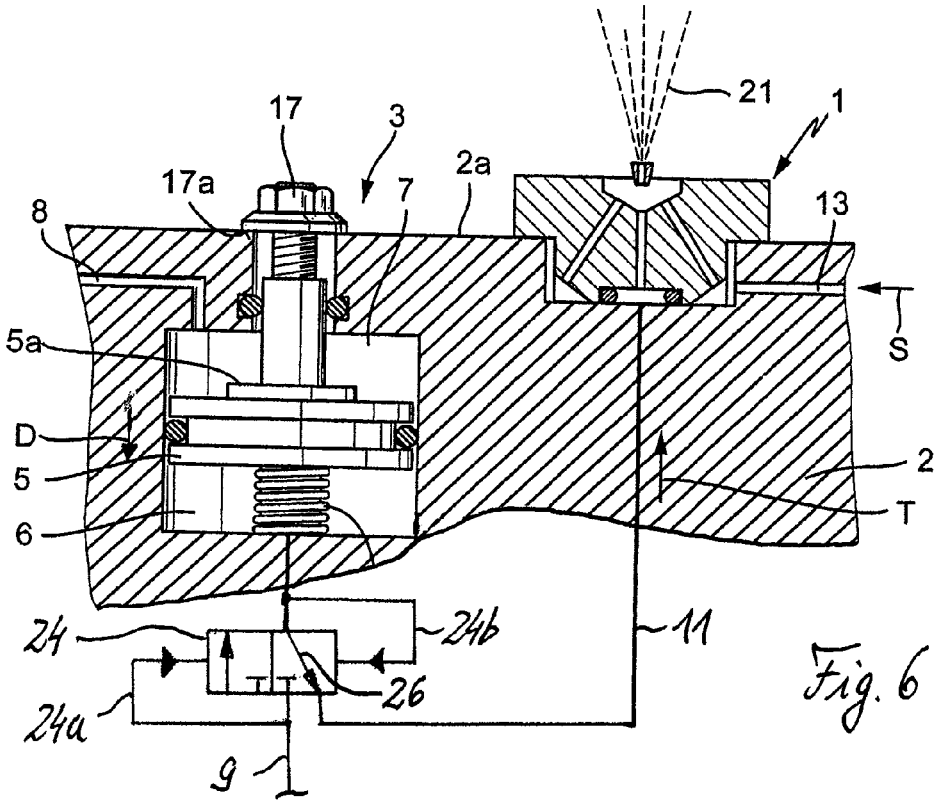
FIG. 6 shows a cross-sectional view corresponding to FIG. 2 for the variant of FIG. 5.

FIGS. 5 and 6 show a further variant of the release agent spray device shown in FIGS. 1 and 2, with identical or functionally equivalent components again being provided with the same reference symbols, and with it being possible in this respect to make reference to the above explanations regarding the release agent spray device of FIGS. 1 and 2. The release agent spray device according to FIGS. 5 and 6 differs from that of FIGS. 1 and 2 in that, instead of the non-return valves, a medium-controlled 3/2directional control valve 24 is provided, to which the release agent supply line 9 and the nozzle connecting line 11 are coupled in a suitable fashion as shown.

Specifically, the coupling is selected such that the valve 24, during the suction process illustrated in FIG. 5, forms a valve throughflow path 25 for the release agent supply line 9, such that release agent can be sucked into the release agent chamber 6 via the release agent supply line 9, and at the same time, said valve 24 interrupts the connection from the release agent chamber 6 to the nozzle connecting line 11. In the spray mode shown in FIG. 6, the valve 24 separates the release agent supply line 9 and thereby blocks the connection between the release agent chamber 6 and the release agent source, while said valve 24 at the same time provides a throughflow path 26 for the nozzle connecting line 11 such that release agent is fed from the release agent chamber 6 via the nozzle connecting line 11 to the spray nozzle 1 and is sprayed from the latter.

The switching of the valve 24 between its two positions shown, in the suction mode of FIG. 5 on the one hand and in the spray mode of FIG. 6 on the other hand, takes place in a medium-controlled fashion by means of the release agent itself, for which purpose the two valve branch lines 24*a*, 24*b* are provided. In the suction mode, a vacuum is generated in the branch line 24*b* relative to the release agent supply line 9 and the branch line 24*a* which is connected thereto, as a result of which the valve 24 is held in its switching position shown in FIG. 5, while in the spraying mode, there is a release agent excess pressure in the branch line 24*b*, by means of which the valve 24 is held in its switching position shown in FIG. 6.

It is self-evident that, as an alternative to the medium-controlled 3/2 directional control valve which is shown, it is possible to use any other desired suitable conventional directional control valve which performs the above-explained valve functions and which is medium-controlled or controlled in some other way.

Otherwise, the variants of FIGS. 5 and 6 result in the same properties and advantages as explained above with regard to the other variants of FIGS. 1 to 4, to which reference can be made in particular with regard to the reliable discharge of a defined predeterminable release agent quantity in the respective spray burst and with regard to further possible modifications to the design of the device. Furthermore, the functional reliability of said variant is not dependent on a fault-free operation of non-return valves, as are provided in the variants of FIGS. 1 to 4.

As is clear from the above explanations, the accuracy of release agent quantity per spray burst which can be obtained with the release agent spray device according to the invention is, in principle, independent of the nozzle cross section of the spray nozzle(s), of the spray duration of the respective spray burst and of the release agent pressure in the release agent source or in the release agent supply line which leads away from the latter. With the release agent spray device according to the invention, it is possible to easily realize very short spray times of less than 1 second without adverse effects. Problems of some conventional release agent spray devices such as fluttering spray jet, non-uniform release agent discharge and different droplet size can be avoided by means of the release agent spray device according to the invention. In this way, the release agent spray device according to the invention permits corresponding advantages with regard to casting quality, environmental impact, material consumption, service life and servicing.

The invention also permits the extremely simple retrofitting of conventional release agent spray devices, since the conventionally used spray nozzles may continue to be used unchanged, and only the dosing unit which is assigned to in each case one individual or a group of several spray nozzles, and an activation of the said dosing unit, must be provided in addition. All of the other conventional system components, such as release agent source, control medium source and spray carrier medium source and the associated control components, may be maintained practically unchanged.

The above description of the preferred embodiments has been given by way of example. From the disclosure given, those skilled in the art will not only understand the present invention and its attendant advantages, but will also find apparent various changes and modifications to the structures and methods disclosed. It is sought, therefore, to cover all changes and modifications as fall within the spirit and scope of invention, as defined by the appended claims, and equivalents thereof.

The invention claimed is:

1. A release agent spray device for a casting machine, comprising:

one or more spray nozzles; and a discharge device for controlled discharge of release agent from the one or more spray nozzles, wherein the discharge device comprises at least one dosing unit assigned to at least one of the one or more spray nozzles, wherein the dosing unit defines, in advance, a release agent quantity to be discharged by the at least one spray nozzle in an impending spray burst, and wherein the dosing unit provides said release agent quantity, separated from a release agent supply, for discharge in the impending spray burst.

2. The release agent spray device according to claim 1, wherein the dosing unit comprises:

a release agent chamber connected, in a blockable manner, to a release agent source via a release agent supply line and to the at least one spray nozzle via a nozzle connecting line; and a dosing element delimiting the release agent chamber and movably arranged in order to vary a volume of the release agent chamber.

3. The release agent spray device according to claim 2, further comprising at least one of:

a non-return valve arranged in the release agent supply line; and a non-return valve arranged in the nozzle connecting line.

4. The release agent spray device according to claim 2, wherein the dosing element is situated in a common housing body with the at least one spray nozzle.

5. The release agent spray device according to claim 2, further comprising:

a control medium source; and wherein the dosing element has a control medium chamber connected to the control medium source for controlling movement of the dosing element.

6. The release agent spray device according to claim 5, wherein the control medium source controls loading of the dosing element with at least two different control pressures, with a first control pressure serving for dosing of release agent into the release agent chamber, and with a second control pressure, which differs from the first, serving for discharge of the dosed release agent.

7. The release agent spray device according to claim 1, wherein the discharge device sets different release agent quantities to be discharged for at least one of different spray nozzles and different spray bursts.

8. The release agent spray device according to claim 7, further comprising:

an adjustable movement limiter assigned to the dosing element;

wherein the adjustable movement limiter variably adjusts the release agent quantity to be discharged by the at least one spray nozzle in the impending spray burst.

9. The release agent spray device according to claim 2, wherein the dosing element comprises one of a dosing piston and dosing diaphragm for delimiting the release agent chamber.

10. The release agent spray device according to claim 2, further comprising:

a multi-way valve arranged for selectively blocking a connection of the release agent chamber to the at least one spray nozzle and opening a connection of the release agent chamber to the release agent source, and for selectively opening the connection of the release agent chamber to the spray nozzle and blocking the connection of the release agent chamber to the release agent source.

* * * * *